United States Patent [19]

Gonwa

[11] Patent Number: 4,609,067

[45] Date of Patent: Sep. 2, 1986

[54] HEAT SHIELD FOR A VEHICULAR MUFFLER

[75] Inventor: Charles J. Gonwa, Palos Hills, Ill.

[73] Assignee: Maremont Corporation, Carol Stream, Ill.

[21] Appl. No.: 732,243

[22] Filed: May 8, 1985

[51] Int. Cl.[4] ..... F01N 7/00

[52] U.S. Cl. ..... 181/211; 181/243; 181/282; 126/83

[58] Field of Search ..... 181/243, 282, 283, 211; 165/134 R; 237/12.3 R, 12.3 A, 79; 126/83

[56] References Cited

U.S. PATENT DOCUMENTS 1,341,126 5/1920 Heller ..... 165/134 R
2,835,336 5/1958 Deremer ..... 181/282
3,237,716 3/1966 Parsons ..... 181/243
4,478,310 10/1984 Harter ..... 181/243 X

*Primary Examiner*—Benjamin R. Fuller
*Attorney, Agent, or Firm*—Allegretti, Newitt, Witcoff & McAndrews, Ltd.

[57] ABSTRACT

A vehicular muffler heat shield comprises at least one and preferably two longitudinally rigid, transversely flexible shield members. The shield members have muffler shell contacting, longitudinal ribs and raised, perforated shield panels. The shield members are identical and longitudinally slidable to fit mufflers of a range of lengths. The shield members are strapped to muffler shells by separate, flexible straps which conform the shield members to muffler shell contours.

2 Claims, 6 Drawing Figures

HEAT SHIELD FOR A VEHICULAR MUFFLER

BACKGROUND OF THE INVENTION

This invention relates to vehicular mufflers, and more particularly, to heat shields for such mufflers.

Vehicular mufflers are heated to high temperatures by internal combustion engine exhaust gases. The mufflers radiate heat, which may be transmitted to automotive underparts, including floor boards and floor covering, and to road surface combustibles, including dry grass, leaves and paper. The result may be damaged underparts, uncomfortable passengers, and roadside fires.

Existing heat shields include a shield by Ford welded and integral to its mufflers, a Goerlich shield as in FIG. 1, and Thrush shields as in FIG. 2. While these shields have proven useful, they are lacking in flexibility, require complex stampings and a multiplicity of parts, are difficult to install, and are only moderately effective at heat dissipation.

SUMMARY OF THE INVENTION

In a principal aspect, the invention is a heat shield for a vehicular muffler of the type which includes a muffler body or shell and end caps. The heat shield comprises a shield member and means for affixing the shield member to the muffler body. The shield member has a plurality of ribs and a plurality of raised panels. The ribs are spaced from each other and each extend longitudinally along the muffler body. Each rib has a muffler body contacting portion and raised portions. The raised panels are perforated, spaced between the ribs, and join the ribs along the raised portions of the ribs.

As preferred, the invention combines two of the shield members as described. One shield member is placed upon the other shield member, and slid longitudinally relative to the other shield member, to extend from end cap to end cap of the muffler, whatever its length may be. Also as most preferred, the affixing means comprises straps separate from the shield members. The straps encircle both the muffler body and the shield members, to hold the shield members securely to the body. The straps and shield members are flexible, so that the straps conform the shield members to the contour of the muffler body, whatever its contour may be.

The invention as summarized and hereafter described in detail has a variety of important advantages: flexibility, i.e., adaptation to a wide range of muffler lengths and contours; economy of manufacture; ease of assembly; and effectiveness in heat dissipation.

BRIEF DESCRIPTION OF THE DRAWING

The accompanying drawing includes six figures. These figures are as follows.

DETAILED DESCRIPTION OF THE PREFERRED EMBODIMENT

Figure 1:
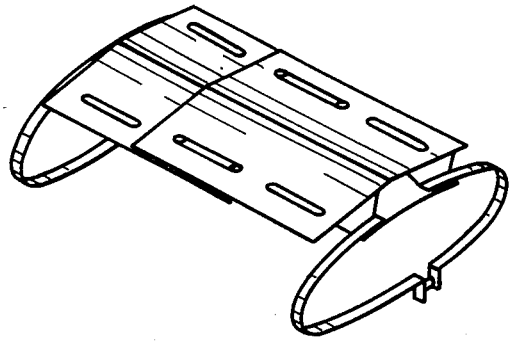
FIG. 1 ( PRIOR ART )
FIG. 1 is a perspective view of a prior art Goerlich heat shield, said to be fully adjustable to fit a wide range of popular oval muffler cross-sections and a range of shell lengths.
Figure 2:
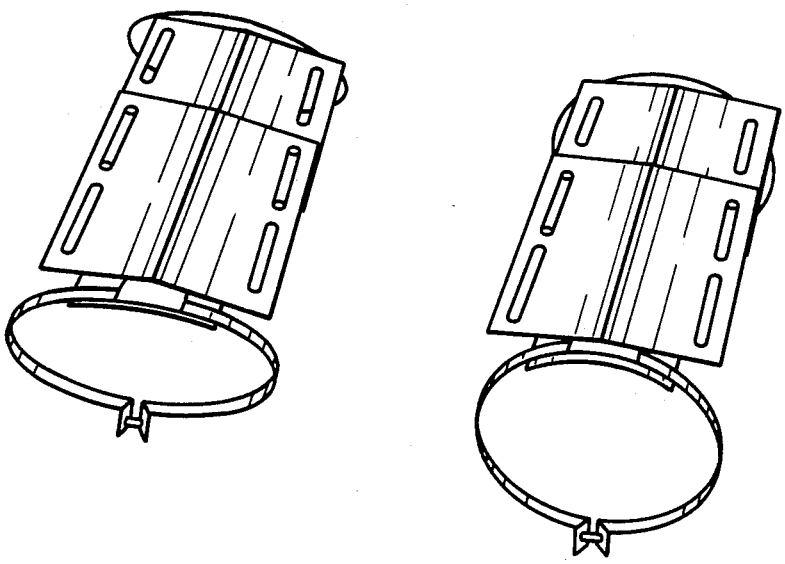
FIG. 2 ( PRIOR ART )
FIG. 2 is a perspective view of prior art Thrush shields, one for oval mufflers and another for round.
Figure 3:
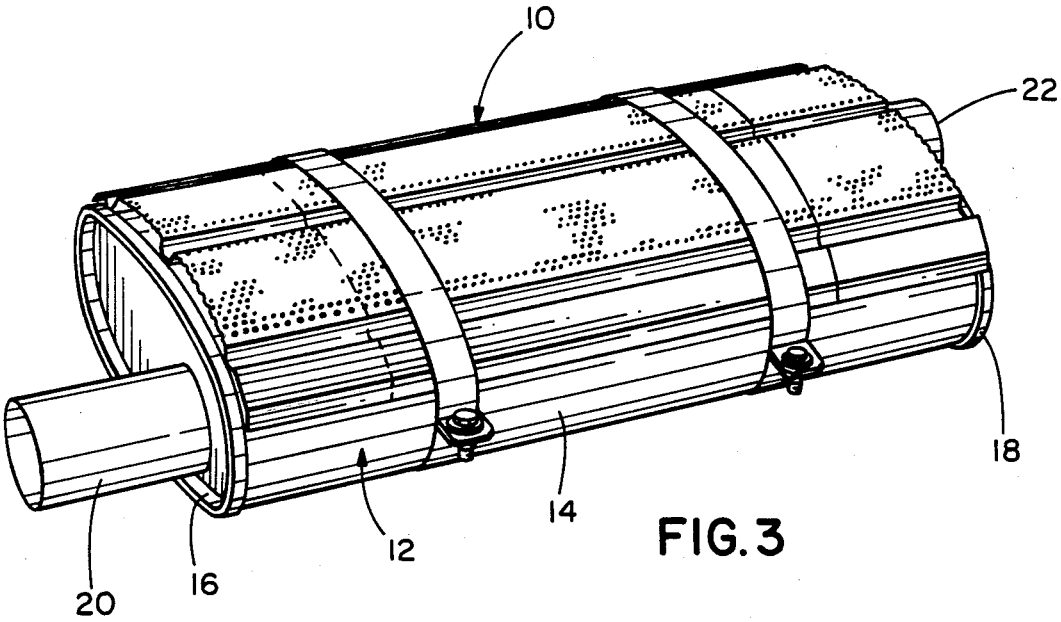
FIG. 3 is a perspective view of the preferred embodiment of the present invention in place on an oval muffler.

Referring to FIG. 3, the preferred embodiment of the present invention is a heat shield 10 adaptable to mufflers such as a muffler 12 having a wide range of muffler shell lengths and shapes.

Typical of such mufflers, muffler 12 includes a shell or body 14, end caps 16, 18, an inlet 20 and an outlet 22. The muffler 12 has a longitudinal extent between the end caps 16, 18, and a transverse extent perpendicular to the longitudinal extent. The longitudinal extent of the muffler defines a longitudinal spatial direction of the muffler and heat shield 10. The transverse extent of the muffler defines a transverse spatial direction of the muffler and heat shield 10.

Figure 6:
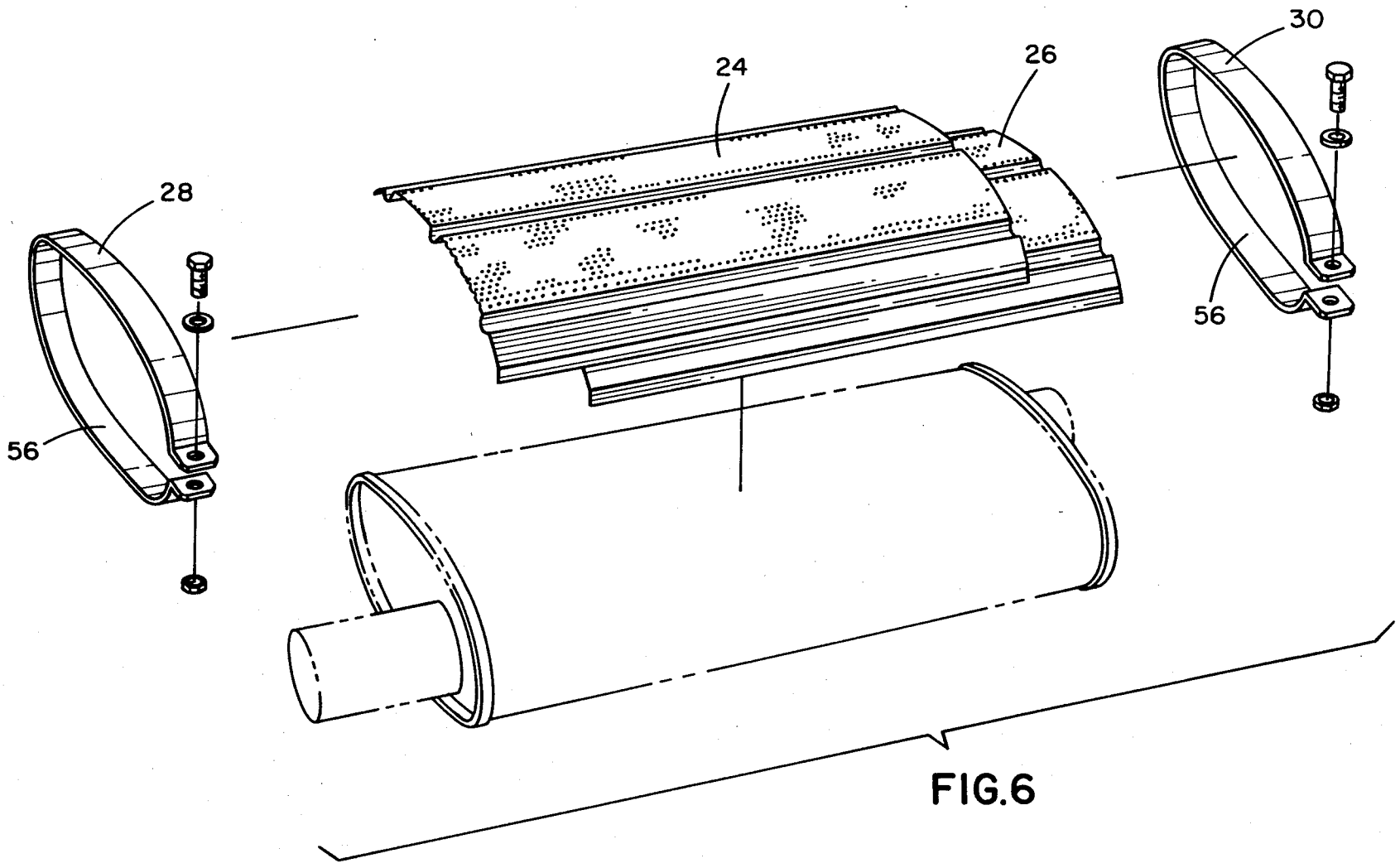
FIG. 6 is a pre-assembled perspective view of the preferred embodiment of the present invention and an oval muffler.

Referring to FIG. 6, the heat shield 10 comprises two shield members 24, 26 and two strap assemblies 28, 30. The shield members 24, 26 are identical to each other, and the strap assemblies 28, 30 are identical to each other.

Figure 4:
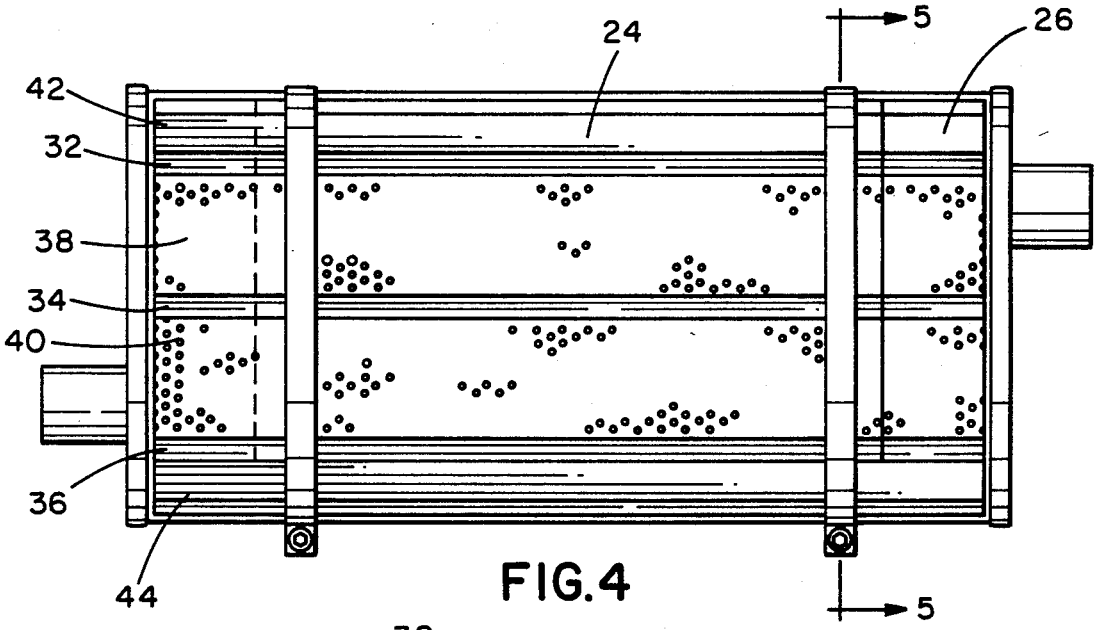
FIG. 4 is a plan view of the preferred embodiment of the present invention in place on an oval muffler.
Figure 5:
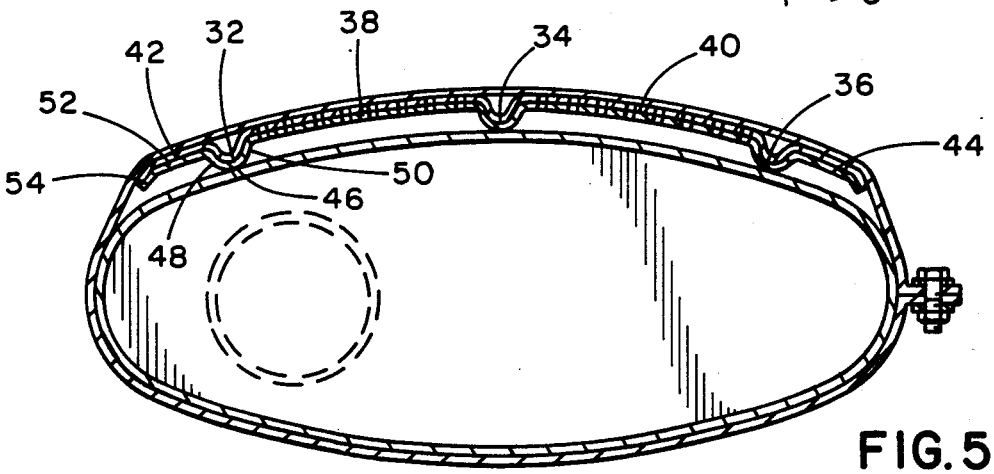
FIG. 5 is a cross-section view taken along line 5-5 of FIG. 4.

Referring to FIGS. 4 and 5, the shield members 24, 26 are formed of metal, such as steel. Each shield member such as 24 includes three ribs 32, 34, 36; two raised panels 38, 40; and two flanges 42, 44. The ribs 32, 34, 36; panels 38, 40; and flanges 42, 44 all extend longitudinally throughout the length of the shield member. The panel 38 is between the ribs 32, 34; the panel 40 is between the ribs 34, 36; the flange 42 is transversely outward of the rib 32; and the flange 44 is transversely outward of the rib 36.

The ribs 32, 34, 36 are spaced transversely from each other. As best viewed in cross-section, each rib such as rib 32 includes three portions: a central muffler body contacting portion 46, and two opposed raised portions 48, 50. The central portion 46 contacts the muffler shell throughout its length. The raised portions 48, 50 extend transversely from the central portion 46 upward, away from and out of contact with the muffler shell. The portions 46, 48, 50 impart a transverse cup shape to the rib.

The ribs are imperforate, as are the flanges. The raised panels 38, 40 are, however, perforated throughout.

The panels 38, 40 are flat and rectangular. The panels join and are joined to the raised portions of the ribs. As a result, the panels are elevated away from the muffler shell.

Each flange such as flange 42, includes two portions: an inner portion 52 and an outer portion 54. The inner portion 52 is rectangular, planar and joined to the outer raised portion of an outer rib. The outer portion 54 is joined to the outer edge of the inner portion 52, and extends at an angle therefrom toward the muffler shell.

The shield members 24, 26 are superimposed, i.e., placed one on top another, with ribs, panels, and flanges all superimposed. The shield members 24, 26 are readily slidable longitudinally relative to each other. As a result, the shield members are useful for forming a heat shield for mufflers of a variety of lengths. The shield members are placed upon the muffler shell, and slid longitudinally until one end of one shield member contacts an end cap and the other end of the other shield member contacts the other end cap.

The shield members are also transversely flexible, to conform to the contour of mufflers, whether round, oval or otherwise.

The strap assemblies 28, 30 each include a strap 56 separate from the shield members, formed of flexible metal. The straps transversely encircle the muffler shell and the shield members 24, 26. The assemblies are completed by suitable fasteners as shown. The straps flex and flex the shield members to conform to the contour of the muffler shell.

The preferred embodiment and the invention are now described in such full, clear, concise and exact terms as to enable a person of skill in the art to make and use the same. To particularly point out and distinctly claim the subject matter regarded as invention, the following claims conclude this specification.

What is claimed is:

1. In a vehicular muffler having a body, opposed end caps affixed to the body, a longitudinal extent between the end caps defining a longitudinal direction, and a transverse extent perpendicular to the end caps, the improvement of a muffler heat shield comprising:

a pair of substantially identical shield members each having (a) a plurality of transversely spaced, transversely cupped and longitudinally extending, imperforate ribs which each have a longitudinally extending muffler body contacting portion being in contact with the muffler body substantially throughout the longitudinal extent of the ribs and which each have longitudinally extending raised portions along the muffler body contacting portions being raised away from the muffler body, and (b) a plurality of raised, perforated panels being joined to and joining the raised portions of the ribs and being raised away from the muffler body, and (c) a pair of opposed, transversely outward, longitudinally extending imperforate flanges;

the pair of shield members being placed one upon another to extend from end cap to end cap of the muffler; and a plurality of straps encircling the muffler body and the pair of shield members transversely, the straps holding the pair of shield members securely to the muffler body.

2. The improvement as in claim 1 in which the shield members and straps are transversely flexible to conform the shield members to the transverse contour of the muffler body.

* * * * *